United States Patent [19]

Pennington

[11] Patent Number: 4,777,932

[45] Date of Patent: Oct. 18, 1988

[54] COUNTERWEIGHT STATIC PRESSURE-AIR FLOW DAMPER ASSEMBLY

[75] Inventor: Rodney L. Pennington, Morris Township, Morris County, N.J.

[73] Assignee: Regenerative Environmental Equipment Co. Inc., Morris Plains, N.J.

[21] Appl. No.: 915,733

[22] Filed: Oct. 6, 1986

[51] Int. Cl.[4] ..... F23L 3/00

[52] U.S. Cl. ..... 126/290; 110/163; 126/285 R

[58] Field of Search ..... 126/285 R, 286, 289, 126/290; 110/163; 236/45

[56] References Cited

U.S. PATENT DOCUMENTS

| | | | |
|---|---|---|---|
| 1,292,132 | 1/1919 | Stoltenberg | 110/163 |
| 2,164,607 | 7/1939 | Cole | 236/45 |
| 2,246,619 | 6/1941 | Cole | 236/45 |
| 2,846,999 | 8/1958 | Loewenheim | 126/285 R |

*Primary Examiner*—Samuel Scott
*Assistant Examiner*—Noah Kamen
*Attorney, Agent, or Firm*—Paul & Paul

[57] ABSTRACT

A barometric damper includes a swingably mounted damper blade having a first adjustable counterweight assembly lying in a common plane with the damper blade and mounted for rotation therewith. The torque arm mass loading can be varied. A second adjustable counterweight assembly coupled to the damper shaft adjusts the static control point of the damper.

13 Claims, 6 Drawing Sheets

COUNTERWEIGHT STATIC PRESSURE-AIR FLOW DAMPER ASSEMBLY

FIELD OF THE INVENTION

The present invention relates to dampers, and more particularly, to static pressure control dampers for operation over a wide range of static pressure.

BRIEF DESCRIPTION OF THE PRIOR ART

Energy conservation systems are widely used throughout many industries for a variety of applications. One application is the use of preheated air streams as make-up air and as a heat source for industrial drying systems. Since most dryers incorporate recirculation loops at each zone, the use of preheated air as a heat source mandates both temperature and flow control. This is usually accomplished with an automated damper system to control both temperature and flow rate. Noting FIG. 1, the recirculation flow path for oven 10 comprises a recirculation duct 11, a return duct 12 and a first blower 14. A burner 25 heats the air in the return duct 12 before the air is delivered to the oven 10. An exhaust path including exhaust duct 18 and second blower 16 is also provided for exhausting steam, particulate matter, and the like. The direction of air flow through the system is indicated by the arrows. A first branch duct 20 is connected to a hot air source (not shown) to introduce heated air into the return duct 12 through temperature regulating controls, including a temperature instrument controller TIC, a temperature operator TZ and a temperature sensor or thermocouple TE. The temperature operator TZ controls valve means positioned within the first branch duct 20 to control the flow of recirculated air therethrough under the control of temperature instrument controller TIC in response to the signal generated by the thermocouple TE positioned in the return duct 12. A second branch duct 22 introduces ambient air into the return duct 12 under control of a pressure instrument controller PIC, a pressure controller PZ, and a pressure sensor PDT, to control the static pressure or flow in the return duct 12.

It can be thus seen that the prior art arrangement of FIG. 1 requires both a temperature control loop and flow or static pressure control loop.

Another system to accomplish the same results is shown in FIG. 2, which incorporates a barometric damper and a temperature control loop. Like elements are designated by like numerals in FIGS. 1 and 2. The arrangement of FIG. 2 eliminates the barometric control loop comprised of elements PIC, PZ and PDT, which are replaced by the barometric damper 24.

Although this second approach eliminates the need for a flow or static pressure control loop, the barometric damper 24 provides control only at a predetermined set point or flow rate. Thus, in applications that require control of temperature over a wide range, the barometric damper is unable to maintain proper static or flow balance in oven 10, which is related to the gravitational effect of the damper blade, as the temperature control point is varied.

SUMMARY OF THE INVENTION

The present invention overcomes the limitations of the barometric damper approach shown in FIG. 2 while eliminating the static pressure control loop of FIG. 1 through the employment of an improved barometric damper having an adjustable weight assembly mounted on a torque arm which is preferably also adjustable. A counterweight attached to the torque arm counteracts the gravitational and frictional effects of the damper blade so that the blade is substantially weightless. The improved barometric damper also includes a disc and a cooperating adjustable disc/linkage counterweight assembly for adjusting the static pressure control of the damper. Weights of an appropriate amount are attached to the linkage coupled to the disc/linkage assembly to obtain the desired static pressure control point. The weight utilized in the disc/linkage assembly provides the desired static pressure control by enabling the damper to assume openings over a wide range of angles at the same static pressure. Preferably, the counter-torque exerted by the disc/linkage assembly is independent of the angular orientation of the damper blade.

It is therefore one object of the present invention to provide a barometric damper having a counterweight assembly which renders the damper blade substantially weightless and provides an adjustable static control counterweight assembly for adjusting the static pressure control point for the damper.

Another object of the present invention is to provide a barometric damper assembly providing a first adjustable weight means for rendering the damper blade substantially weightless and a second adjustable weight means for selecting the damper static pressure control point.

BRIEF DESCRIPTION OF THE DRAWINGS

The above as well as other objects of the present invention will become apparent when reading the accompanying description and drawings, in which like reference numerals refer to like elements, and in which.

DETAILED DESCRIPTION OF THE PREFERRED EMBODIMENTS

Figure 1:
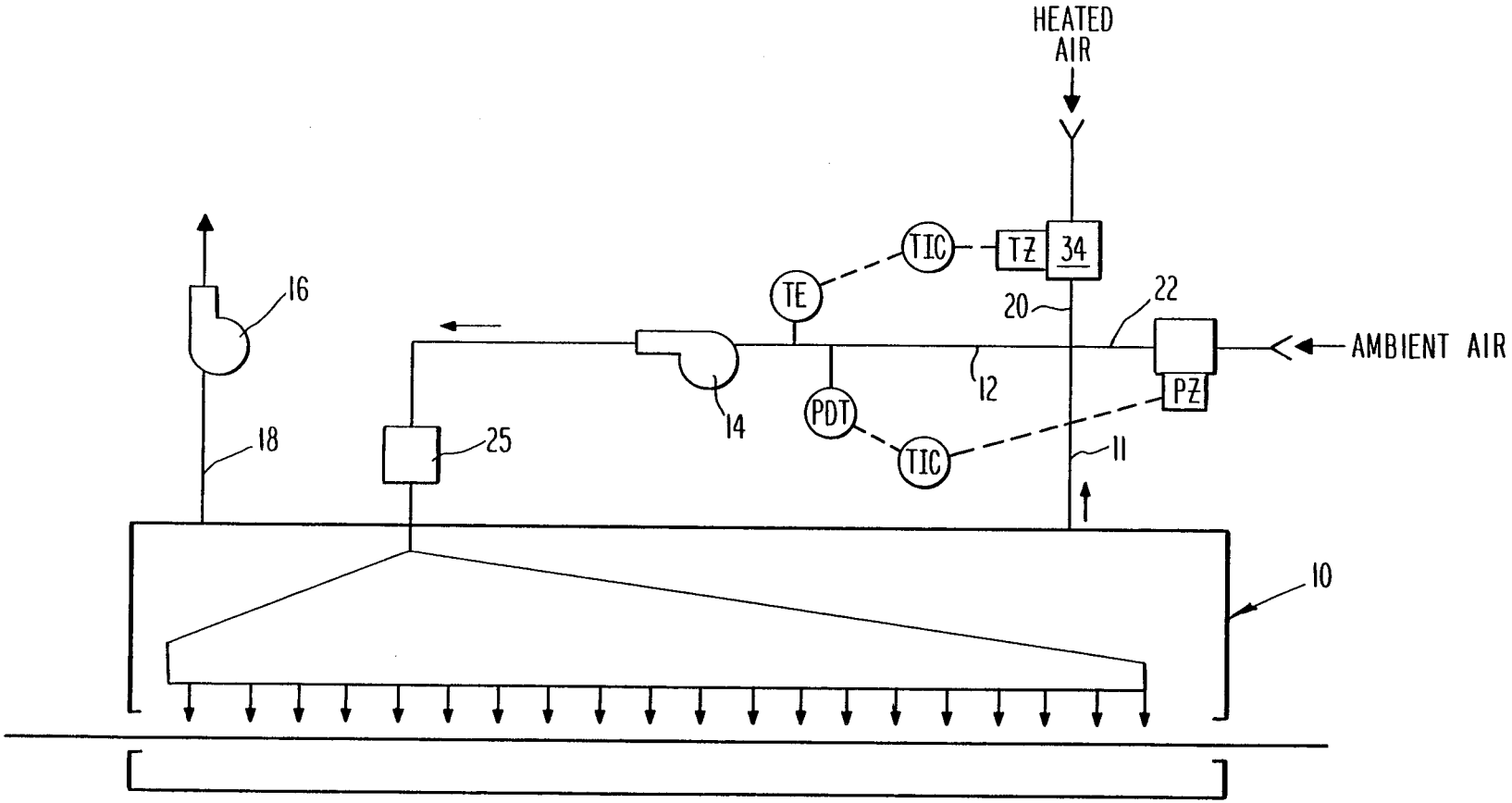
PRIOR ART Fig. 1
FIGS. 1 and 2 are schematic diagrams showing conventional pressure and temperature control arrangements employed in heat recovery systems.
Figure 2:
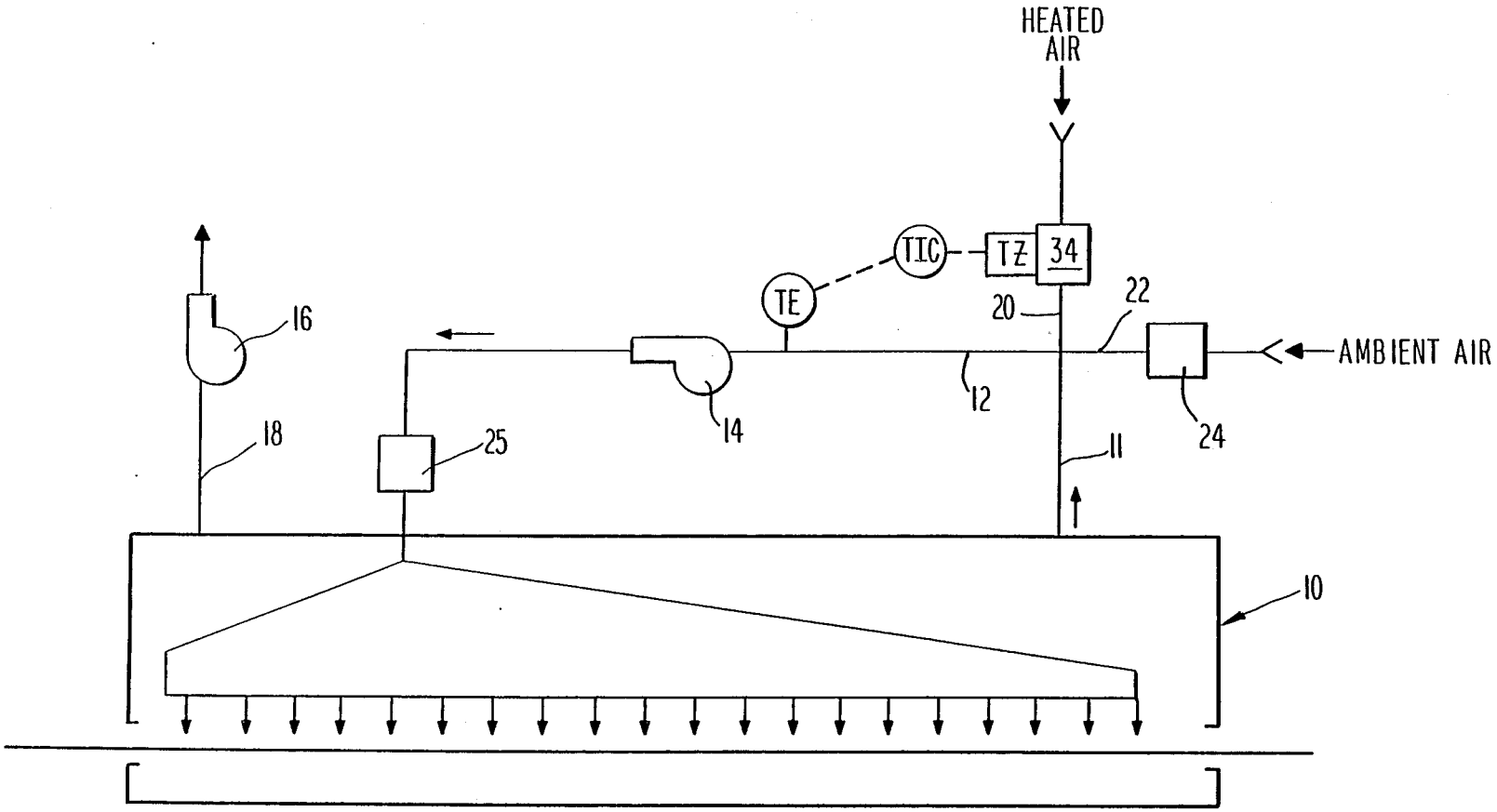
PRIOR ART Fig. 2
Figure 3:
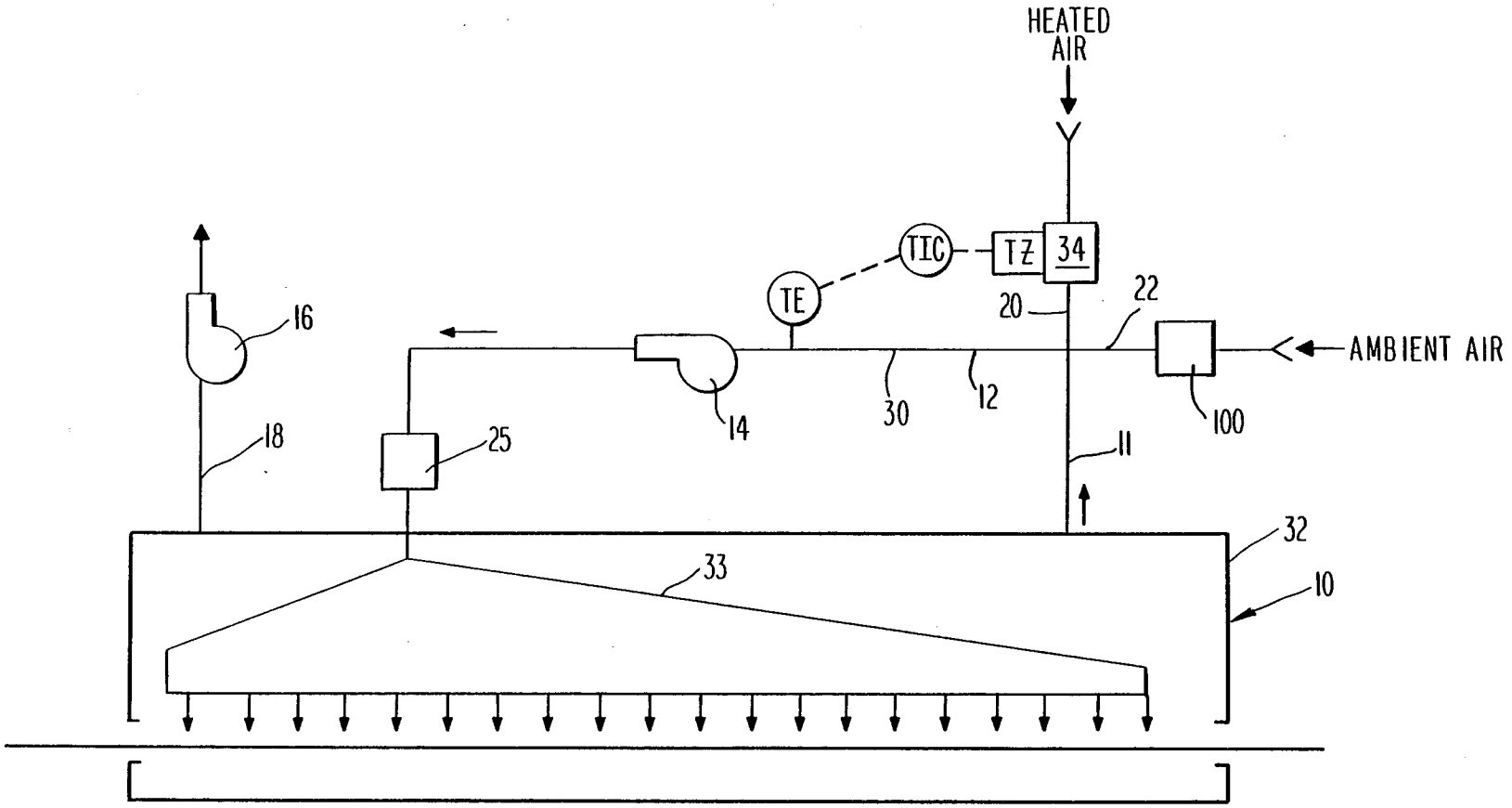
FIG. 3 is a schematic diagram showing a typical application in which a static control damper of the present invention can be employed.

FIG. 3 shows a system 30 in which a static control damper 100 of the present invention can be employed. The system 30 includes an oven 10 having a housing 32 and a driver (nozzle) supply 33 for providing heat within the housing 32. Such ovens can be used for drying articles conveyed therethrough on conveyor means (not shown) and the like.

The air to be recirculated is obtained from the oven 10 through a recirculation duct 11 and returned to the oven 10 through return duct 12 aided by a first blower 14. The air delivered to the oven 10 is heated by burner 25. Air which is not to be recirculated can be exhausted from housing through an exhaust duct 18 aided by a second blower 16.

Preheated air can be introduced through a first branch duct 20. The amount of preheated air introduced into the return duct 12 is controlled by a thermocouple TE positioned in the return duct 12, a temperature instrument controller TIC, and a temperature controlled operator TZ for operating a damper 24 in the first branch duct 20. A static control damper 100 introduces fresh air into the return duct 12 through a second branch duct 22.

Figure 4:
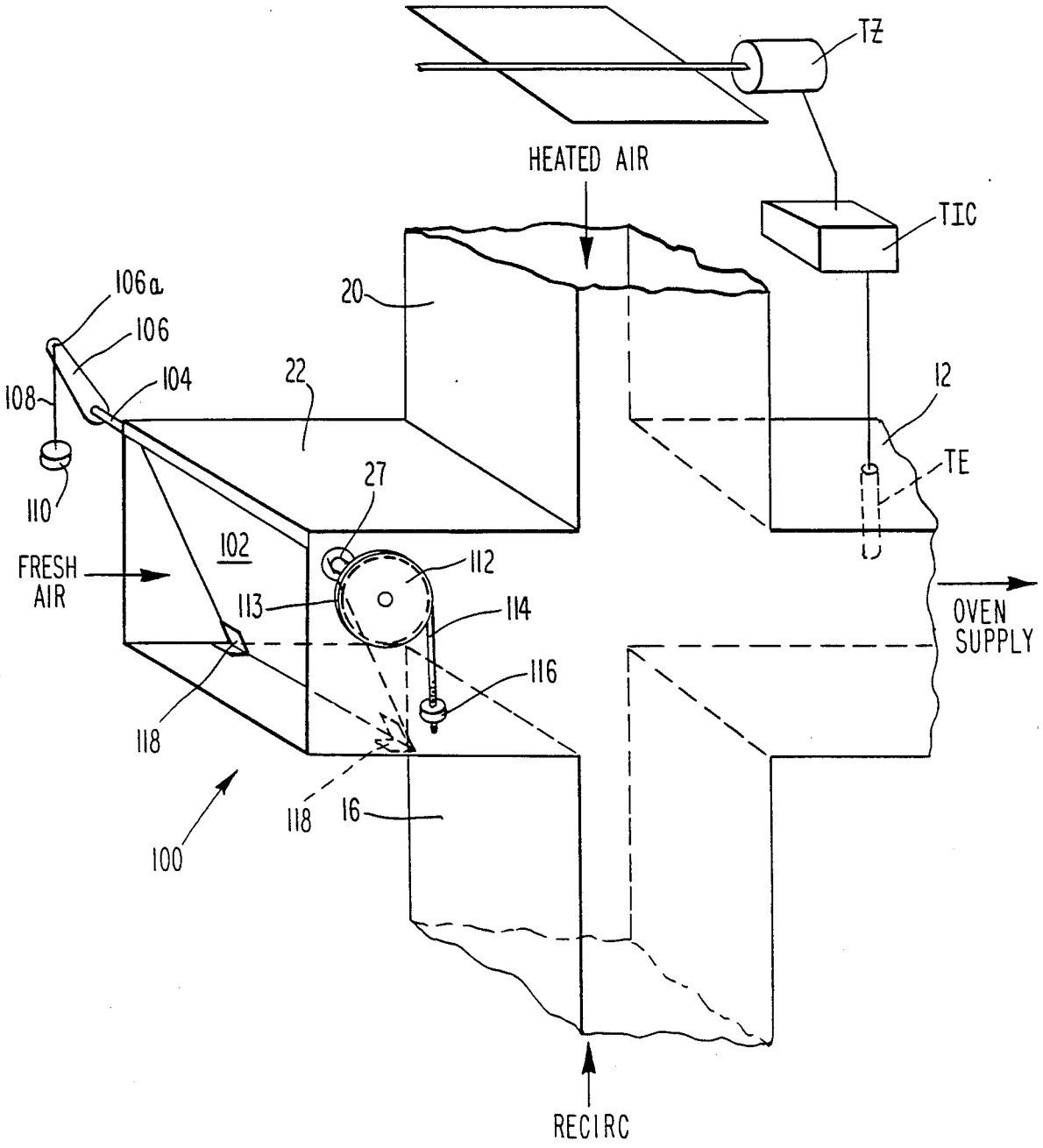
FIG. 4 is a perspective view of a static control damper of the present invention.
Figure 5A:
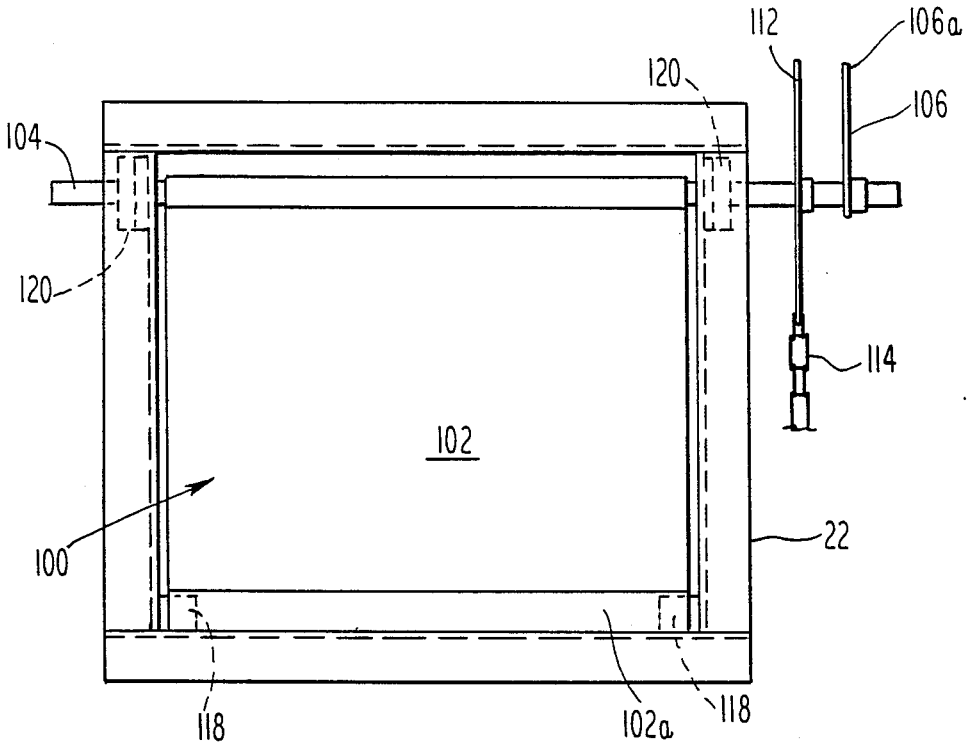
FIG. 5*a* is a fragmentary front elevational view of a static control damper of a second embodiment of the present invention.

FIG. 4 shows a simplified perspective view of the damper blade assembly 100 of a first embodiment of the present invention which comprises a damper blade 102 mounted proximate one edge thereof on a shaft 104 for rotation with the shaft 104 (best seen in FIG. 5*a*). Alternatively, the damper blade 102 can include integrally formed pivots (not shown). At rest, the damper blade 102 is preferably oriented at an acute angle relative to the vertical; in the preferred embodiment this angle is of the order 20 to 25 degrees. The damper blade 102 is swingably mounted for rotation about an axis of rotation adjacent an open end of a duct for controlling the flow of gas into the duct.

A torque arm 106 is secured to one end of the shaft 104 and is aligned so as to lie in a common plane but oriented in a direction substantially opposite to that of the damper blade 102 with respect to the shaft 104 (i.e., forming a 180° angle with the damper blade 102). The free end 106*a* of the torque arm 106 is coupled to a first weight 110 through a flexible coupling member or rope 108. The magnitude of the first weight 110 placed upon the flexible member 108 is selected to counterbalance the weight of the damper blade 102 and associated frictional forces to render the damper blade 102 substantially "weightless." The length of the torque arm 106 is preferably variable to provide an additional degree of freedom in balancing the damper blade 102 (not shown).

The static pressure in the return duct 12 is regulated by the disc 112 mounted to the opposite end of the shaft 104 and rotatable therewith (FIG. 4). A flexible linking member or chain 114 is coupled to a point along the circumference of the disc 112 and is adapted to receive and mount a second weight 116, the magnitude of the weight being selected to adjust the static pressure control point within the return duct 12. The chain 114 is received in a groove 113 formed in the outer periphery of its disc 112. Thus, the torque exerted by the second weight 116 on the shaft 104 is advantageously constant and independent of the extent to which the damper blade assembly 100 is open and the angular orientation of the damper blade 102 when it is open. The flexible linking member 114 mounted with the disc 112 is thus similar to a line passing over a pulley and having one end fixed to the pulley proximate the outer perimeter of the pulley.

In operation, the static pressure causes the damper blade 102 to be lifted when the negative pressure within the return duct 12 is less than atmospheric or set point (generally negative) pressure, the angle through which damper blade 102 rotates in the counterclockwise direction (with respect to FIG. 4) being a function of the pressure differentials and the magnitude of the second weight 116 coupled to linkage 114. Stops 118 are arranged along the floor of the second branch duct 22 in which damper blade 102 is mounted to limit the movement of damper blade 102 in the clockwise direction (with respect to FIG. 4). Preferably, the stops 118 are placed to give the damper blade 102 an angle of about 25° with respect to the vertical when the damper blade assembly 100 is closed. Thus, when the damper blade assembly 100 first opens, laminar flow through the damper is promoted and turbulence and additional forces resulting from velocity pressure of air flow are minimized.

The lower end of damper blade 102 is preferably provided with a resilient flexible rubber of rubber-like strip 20*a* to improve the seal between the floor of the second branch duct 22 and the damper blade 102. The damper blade 102 is thus only lifted to open the second branch duct 22 to the atmosphere when the negative pressure in the return duct 12 exceeds the set point pressure.

FIGS. 5*a* through 5*e* show detailed views of a second embodiment of the damper assembly. It can be seen from FIGS. 5*a*, 5*b* and 5*c* that the disc 112 and the lever arm 106 can both be mounted on the same end of the shaft 104, which is preferably mounted to the second branch duct 22 by means of a pair of flange bearings 120. In the embodiment shown in FIGS. 5*a* through 5*e*, and specifically in FIGS. 5*b* and 5*c*, linking member 114 is a double-pitched chain comprised of a plurality of pairs of links 114*a* coupled together end-to-end by pins 114*b*. The bottom-most link 121 is coupled to a block 122 having a threaded rod 124 at its lower end for threadedly engaging a suitable weight (not shown).

Figure 5B:
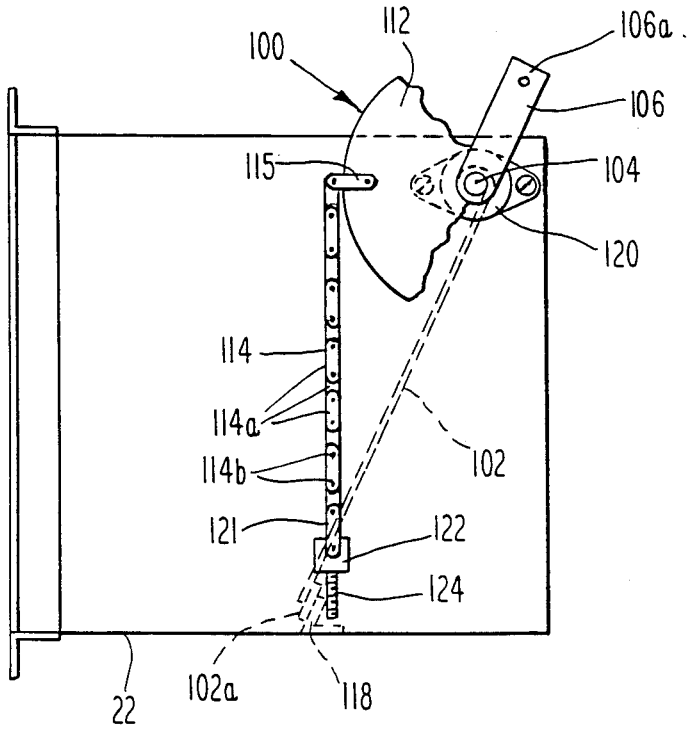
FIG. 5*b* is a fragmentary side elevational view of the damper of FIG. 5*a*, showing the damper closed, with the weights removed for clarity.
Figure 5C:
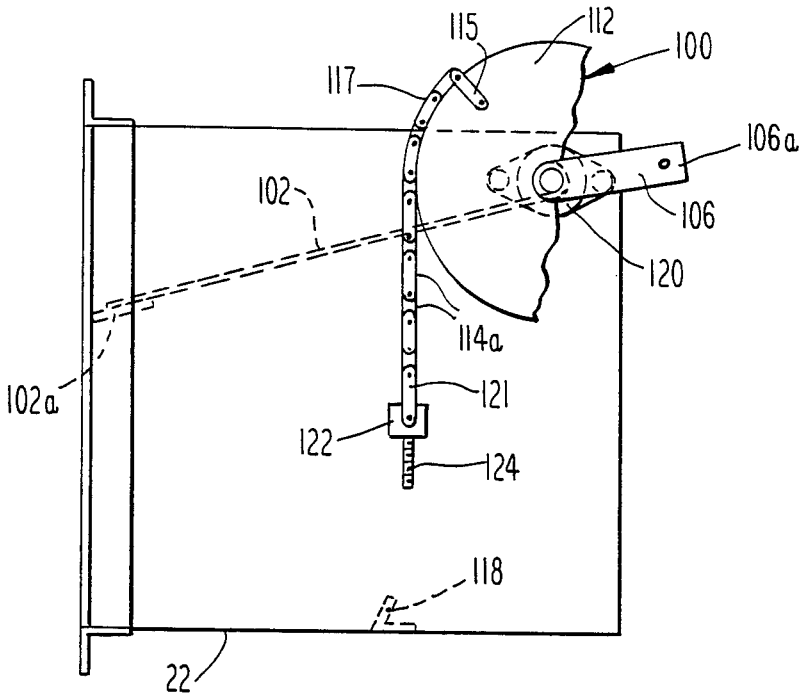
FIG. 5*c* is a fragmentary side elevational view of the damper of FIGS. 5*a* and 5*b*, showing the damper in an open position, with the weights removed for clarity.
Figure 5D:
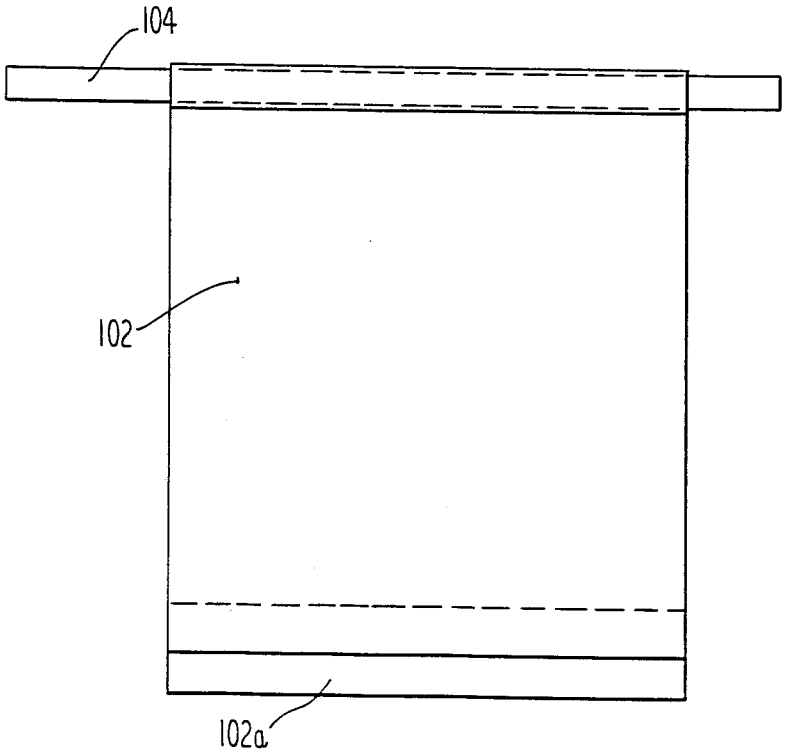
FIG. 5*d* is an enlarged front elevational view of the damper blade and associated shaft of the damper of FIGS. 5*a* and 5*b*.
Figure 5E:
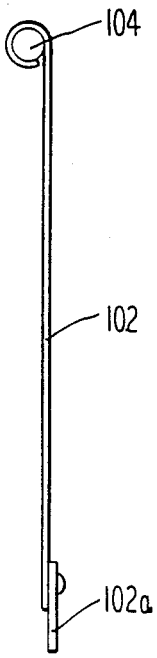
FIG. 5*e* is an enlarged side elevational view of the damper blade and shaft of FIGS. 5*a* and 5*b*.

In this embodiment, as best seen in FIGS. 5*b* and 5*c*, the double-pitched chain 114 is fixed at one end 115 to the disc 112. A first portion 117 of the chain 114 is carried on the upper portion of the outer periphery of the disc 112 as the disc 112 rotates when the damper blade 102 simultaneously rotates from a closed (FIG. 5*b*) to a fully open position (FIG. 5*c*). A second portion 119 of the chain 114 extends vertically downward from the disc 112. Thus, the torque exerted by the weight attached to the threaded rod 124 is constant and independent of the orientation of the damper blade 102 over this range of damper blade orientations.

In operation, a first weight 110 is selected for coupling to the torque arm 106 to counterbalance the weight of damper blade 102 as well as any friction encountered in the swingable mounting (e.g., between the flange bearings 120 and the shaft 104). The second weight 116, which threadedly engages the threaded member 124, is then selected to have a magnitude which fixes the static control point for operation of damper blade 102.

The blade 102 is thus effectively weightless while the second weight 116 threadedly mounted upon threaded member 124 increases the pressure required to move the damper blade 102 from its closed position as the second weight 116 is increased. With the present invention, damper openings from about 25 to 70 degrees are possible at the same static pressure, for example one-half inch of water.

As will be recognized by those skilled in the art, latitude of modification, change and substitution is intended in the foregoing disclosure, and in some instances, some feature of the invention will be employed without a corresponding use of other features. For example, while ducts having rectangular cross-sections are illustrated, ducts with circular or other cross-sections can also be used with the apparatus of the present invention. Accordingly, it is appropriate that the appended claims be construed broadly and in a manner consistent with the spirit and scope of the invention herein.

I claim:

1. A barometric damper comprising:

a damper blade being swingably mounted in a duct about an axis of rotation adjacent an open end of the duct for controlling the flow of gas into the duct;

a torque arm secured to the damper blade;

a first weight means coupled to the torque arm for substantially balancing the damper blade to substantially render the damper blade weightless;

a second weight means; the second weight means being selected to control the amount of pressure differential required on opposite sides of the damper blade to lift the damper blade;

coupling means coupling said second weight means and said damper blade; and said second weight means and said coupling means comprising means for maintaining a constant torque at a give static pressure on said damper blade, toward a damper-closed position, regardless of changes in the angle of orientation of the damper blade.

2. The barometric damper of claim 1 wherein the damper blade is mounted in the duct to form an acute angle relative to the vertical when the amount of differential pressure is less than that required to lift the damper blade and the damper is closed.

3. The barometric damper of claim 2 wherein the acute angle is between about 20 to 25 degrees.

4. The barometric damper of claim 1 wherein the damper blade assembly includes a shaft and the upper end of the damper blade is mounted to rotate with the shaft.

5. The barometric damper of claim 4 wherein said coupling means comprises a member secured to the shaft for rotation with the shaft and the damper blade and wherein said member is a circular disc with a concentric mounting in relation to said shaft and having a second coupling means for coupling a weight to the member.

6. The barometric damper of claim 5 wherein the second coupling means comprises a flexible member fixed at one end to the disc; a first portion of the flexible member being carried on the upper portion of the outer periphery of the disc, a second portion of the flexible member extending vertically downward and carrying the weight at the other end of the flexible member thereby.

7. The barometric damper of claim 6 further including a flexible member joined at one end to the periphery of the disc and the opposite end of the flexible member is adapted to threadedly engage a weight whose magnitude is chosen to control the amount of differential pressure required to open the damper.

8. The barometric damper of claim 7 wherein the flexible member comprises a chain.

9. The barometric damper of claim 1 wherein the duct has a floor and the floor of the duct is provided with a stop member for limiting the movement of the damper blade and for determining the closed position of the damper blade.

10. The barometric damper of claim 9 further comprising a resilient member mounted on the floor of the duct for improving the seal between the duct and the damper blade when the damper is closed.

11. The barometric damper of claim 9 wherein the stop member permits the damper blade to lift allowing air to enter into the duct when the pressure in the duct is reduced below atmospheric pressure by a predetermined pressure differential while preventing movement of the damper blade from the closed position when the pressure in the duct is greater than atmospheric.

12. The barometric damper of claim 1 wherein the weight of the torque arm can be adjusted to balance the damper blade against the weight of the torque arm.

13. The barometric damper of claim 1 wherein the torque arm lies in a substantially common plane with the damper blade, the torque arm extending in a direction substantially opposite with respect to the damper blade.

* * * * *